US006307484B1

(12) United States Patent
Sasaki et al.

(10) Patent No.: US 6,307,484 B1
(45) Date of Patent: Oct. 23, 2001

(54) INTERSECTION WARNING SYSTEM

(75) Inventors: Kenji Sasaki, Gotenba; Yuji Kobayashi, Fuchu; Noriaki Hattori, Anjo; Kazuhiko Yamaguchi, Gifu, all of (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 09/126,134

(22) Filed: Jul. 30, 1998

(30) Foreign Application Priority Data

Jul. 31, 1997 (JP) ..... 9-206970

(51) Int. Cl.[7] ..... G08G 1/16

(52) U.S. Cl. ..... 340/903; 340/905; 340/917; 340/933; 340/436

(58) Field of Search ..... 340/903, 905, 340/917, 910, 933, 935, 436

(56) References Cited

U.S. PATENT DOCUMENTS 4,727,371 * 2/1988 Wulkowicz ..... 340/917
5,926,114 * 7/1999 Andrews ..... 340/909
5,939,976 * 8/1999 Sasaki et al. ..... 340/435

FOREIGN PATENT DOCUMENTS 53-27932 3/1978 (JP) .

OTHER PUBLICATIONS

"Information Disclosure Statement" (1 page).

* cited by examiner

*Primary Examiner*—Daryl C. Pope
(74) *Attorney, Agent, or Firm*—Finnegan, Henderson, Farabow, Garrett & Dunner, L.L.P.

(57) ABSTRACT

An intersection warning system provided in a first vehicle, includes a receiving unit receiving information about a running state of a second vehicle near a roadside edge in a sideward or rearward area of the first vehicle, the information being transmitted from a roadside system watching a predetermined watched area through which vehicles approaching an intersection pass, a running state detecting unit detecting a running state of the first vehicle, an estimation unit estimating a relative position relationship between the first and second vehicles in the intersection based on the running state of the first vehicle detected by the running state detecting unit and the information about the running state of the second vehicle received by the receiving unit, and a warning unit issuing a warning to a driver of the first vehicle based on an estimation result obtained by the estimation unit.

11 Claims, 6 Drawing Sheets

INTERSECTION WARNING SYSTEM

BACKGROUND OF THE INVENTION

1. Field of the Invention

The present invention generally relates to an intersection warning system, and more particularly to an intersection warning system issuing a warning to a driver of a vehicle running near a roadside edge and approaching an intersection, based on a state of another vehicle running, near the roadside edge, in a sideward or rearward area of the vehicle.

2. Description of the Related Art

For example, in a case where every vehicle ought to run on a left side of a road, a driver of a vehicle running near the roadside edge and approaching an intersection to turn left at the intersection has to pay attention to another vehicle (e.g., a two-wheeled vehicle) running in a left sideward or rearward area of the vehicle. In a case where every vehicle ought to run on a right side of a road, a vehicle which is going to turn right at an intersection is also in the same situation.

To support the driver of such a vehicle which is going to turn left at an intersection, conventionally, a vehicle contact warning apparatus has been proposed (Japanese Laid-Open Patent Application No.53-27932). In this vehicle contact warning apparatus, a watching unit (including an ultrasonic sensor) watching a dead angle area in a left side of the vehicle is provided in the vehicle. When a direction indicating operation (a turn signal operation) to turn left is carried out, the driver is warned, based on information from the watching unit, that there is another vehicle in the dead angle area.

According to the conventional vehicle contact warning apparatus, when a vehicle is going to turn left at an intersection, a driver can recognize whether there is another vehicle in the dead angle area on the left side of the vehicle. Thus, the driver can drive the vehicle to turn left at the intersection without contacting another vehicle.

In the conventional vehicle contact warning apparatus, whenever there is another vehicle in the dead angle area on the left side of the vehicle, the warning is issued. For example, there is a case where the vehicle passes by another vehicle which stops on the left side of the road. In this case, while the other vehicle is in the dead angle area of the vehicle, the warning is issued. Thus, the warning is not necessarily appropriate for a driver of a vehicle which is going to turn along the roadside edge (turn left in a case where every vehicle ought to run on the left side of a road or turn right in a case where every vehicle ought to run on the right side of a road) without crossing the road at an intersection.

SUMMARY OF THE INVENTION

Accordingly, a general object of the present invention is to provide a novel and useful intersection warning system in which the disadvantages of the aforementioned prior art are eliminated.

A more specific object of the present invention is to provide an intersection warning system capable of issuing a warning appropriate for a driver of a vehicle which is going to turn along the roadside edge at an intersection without crossing the road.

The above objects of the present invention are achieved by an intersection warning system provided in a first vehicle, comprising: a receiving unit receiving information about a running state of a second vehicle near a roadside edge in a sideward or rearward area of the first vehicle, the information being transmitted from a roadside system watching a predetermined watched area through which vehicles approaching an intersection pass; a running state detecting unit detecting a running state of the first vehicle; an estimation unit estimating a relative positional relationship between the first and second vehicles in the intersection based on the running state of the first vehicle detected by the running state detecting unit and the information about the running state of the second vehicle received by the receiving unit; and a warning unit issuing a warning to a driver of the first vehicle based on an estimation result obtained by the estimation unit.

According to the above intersection warning system, while the first vehicle is approaching the intersection, the relative positional relationship between the first vehicle and the second vehicle running near the roadside edge in the sideward or rearward area of the first vehicle is estimated based on the running state of the first vehicle and the running state of the second vehicle received from the roadside system. A warning is issued to the driver of the first vehicle based on the estimation result.

The relative positional relationship between the first and second vehicle corresponds to a relative positional relationship between the second vehicle and the first vehicle located at a position at which the first vehicle will turn along the road without crossing the road. Thus, in a case where it is estimated that the first vehicle turning at the intersection along the road without crossing the road will come into contact with the second vehicle running near the roadside edge in the sideward or rearward of the first vehicle, the warning is issued.

The information about the running state supplied from the roadside system may include a position and a moving vector.

The driver of the first vehicle should pay attention to the second vehicle near the roadside edge in the sideward or rearward area of the first vehicle when the first vehicle is going to turn at the intersection along the roadside edge without crossing the road. Thus, the intersection warning system described above may further comprise a determination unit determining whether the driver of the first vehicle is going to cause the first vehicle to turn at the intersection along the roadside edge without crossing the road; and a first control unit allowing the warning unit to issue the warning to the driver when the determination unit determines that the driver of the first vehicle is going to cause the first vehicle to turn at the intersection along the roadside edge.

To supply information about the second vehicle, near the roadside edge in the sideward or rearward area of the first vehicle, to the driver by stages, the watched area is segmented into a first area and a second area which is nearer the intersection than the first area, and the intersection warning system may further comprise: an information supply unit supplying information indicating that there is another vehicle near the roadside edge in the sideward or rearward area of the first vehicle, based on the information about the running state of the second vehicle received by the receiving unit, to the driver while the first vehicle is running in the first area; and a second control unit allowing the warning unit to issue the warning to the driver.

According to the intersection warning system, while the first vehicle is running in the first area, the information about the second vehicle running near the roadside edge in the sideward or rearward area of the first vehicle is supplied to the driver of the first vehicle. The driver recognizes that there is the second vehicle near the roadside edge in the sideward or rearward area of the first vehicle and drives the first vehicle to approach the intersection. If the driving operation is appropriate, no warning is issued. On the other hand, if the driving operation is not appropriate, a warning is issued.

Further, to avoid contact between the first and second vehicle at the intersection even if although the warning is issued to the driver, the driving operation is not corrected so as to be appropriate, the intersection warning system may further comprise a braking control unit carrying out a braking control of the first vehicle based on the estimation result obtained by the estimation unit.

BRIEF DESCRIPTION OF THE DRAWINGS

Other objects, features and advantages of the present invention will be apparent from the following description when read in conjunction with the accompanying drawings, in which.

DESCRIPTION OF THE PREFERRED EMBODIMENTS

A description will be given, with reference to the drawings, of an embodiment of the present invention. In the embodiment, every vehicle ought to run on the left side of a road.

Figure 1:
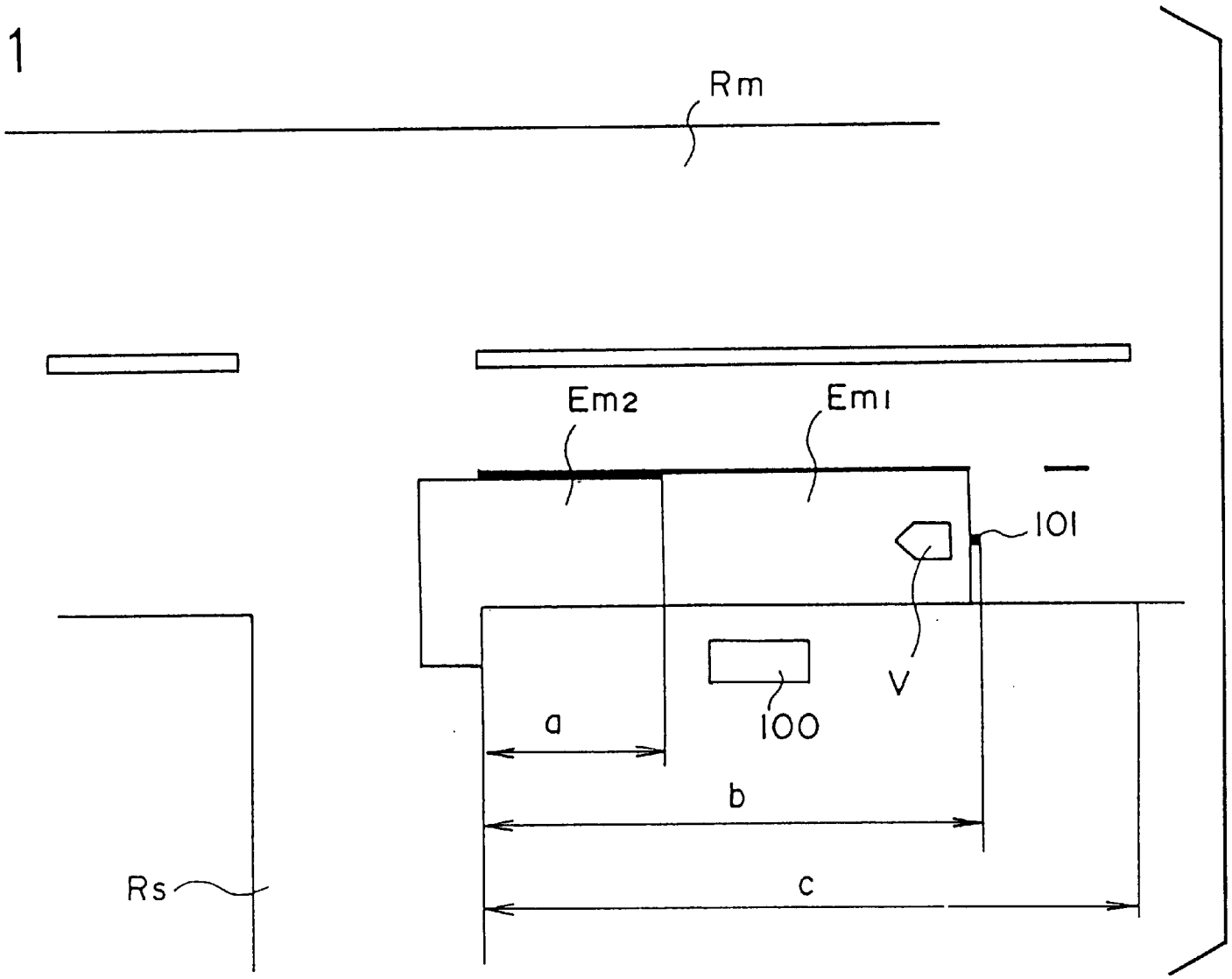
FIG. 1 is a diagram illustrating a state of an intersection to be watched by a road watching apparatus.

An intersection to be watched by a road watching apparatus is, for example, in a state as shown in FIG. 1.

Referring to FIG. 1, a predetermined area, in a left-turn/straight pass lane, before an intersection (a T-shaped intersection) at which a main road Rm and a side road Rs intersect each other, is set as a watched area. The watched area has a length c (e.g., 50 meters) from the intersection. An area, in the watched area, between positions which are lengths b (e.g., 30 meters) and a from the intersection is set as a primary warning area Em1. An area, in the watched area, having the length a from the intersection is set as a secondary warning area Em2. A running length of a vehicle which is running at 30 km/h for one second is about 8 meters. Thus, the length a of the secondary warning area Em2 may be set at 8 meters.

A roadside communication unit 100 is installed so as to face the watched area. The roadside communication unit 100 has a communication area including the watched area and transmits watching information obtained from the road watching apparatus to the watched area. At the entrance of the primary warning area Em1 on the main road Rm, a lane marker 101 is installed. The lane marker 101 has a function for emitting information, such as an approaching direction to the intersection and an absolute position of the lane marker 101. A set of a plurality of magnets may be used as the lane marker 101 (a magnet marker). In this case, the various kinds of information are represented by directions of magnetic poles of the plurality of magnets.

Figure 2:
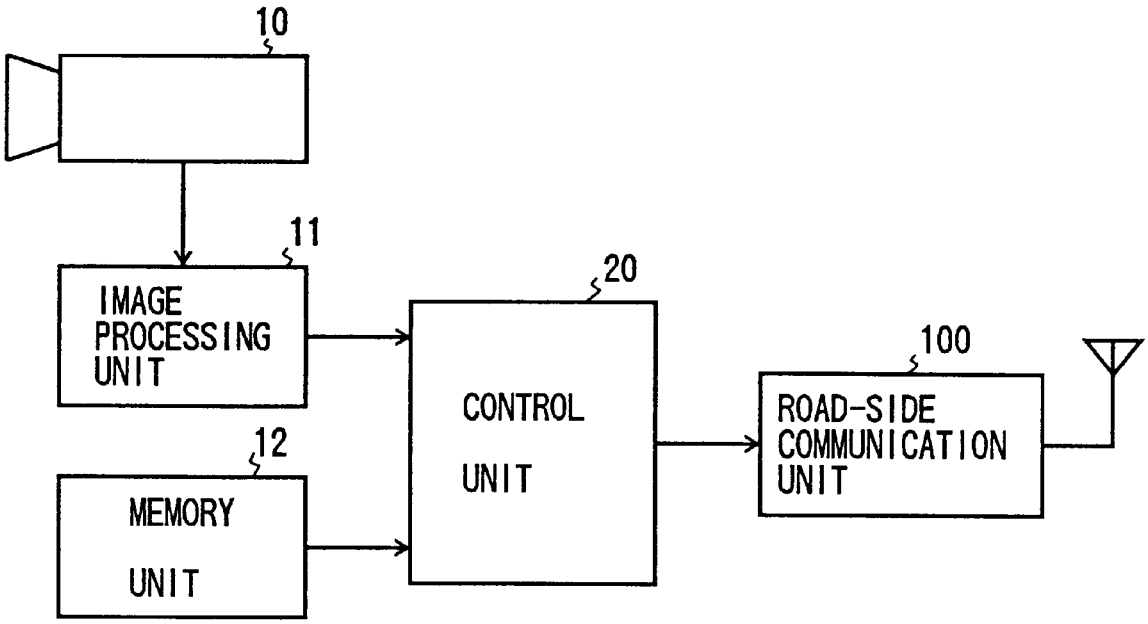
FIG. 2 is a block diagram illustrating a roadside system.

A roadside system including the road watching apparatus and the roadside communication unit is formed as shown in FIG. 2.

Referring to FIG. 2, the roadside system has a camera 10, an image processing circuit 11, a memory unit 12, a control unit 20 and the roadside communication unit 100. The camera 10 takes pictures of the watched area (see FIG. 1). The camera 10, the image processing unit 11, the memory unit 12 and the control unit 20 are included in the road watching apparatus.

Image signals from the camera 10 are processed by the image processing circuit 11 so that image information of bodies in the watched area is generated. Map information is stored in the memory unit 12. The control unit 20 calculates figure information identifying the intersection based on the image information from the image processing circuit 11 and the map information read out of the memory unit 12. The control unit 20 further calculates information about running states, such as position information and moving vectors, of the bodies (vehicles and other bodies) in the watched area. The figure information of the intersection and the information about the running states of the respective bodies are supplied to the roadside communication unit 100. These kinds of information are transmitted from the roadside communication unit 100 toward the watched area.

An intersection warning system is provided in a vehicle (an AHS (Automated Highway System) vehicle). Hereinafter, this type of vehicle is referred to as an intelligent vehicle. While the intelligent vehicle is running in the watched area to approach the intersection, the intersection warning system receives the watching information from the roadside communication unit 100 (roadside-vehicle communication). A running state of another vehicle in the left sideward or rearward area of the intelligent vehicle is determined based on the watching information. The intersection warning system then issues a warning based on a relationship between the running states of the other vehicle and the intelligent vehicle.

Figure 3:
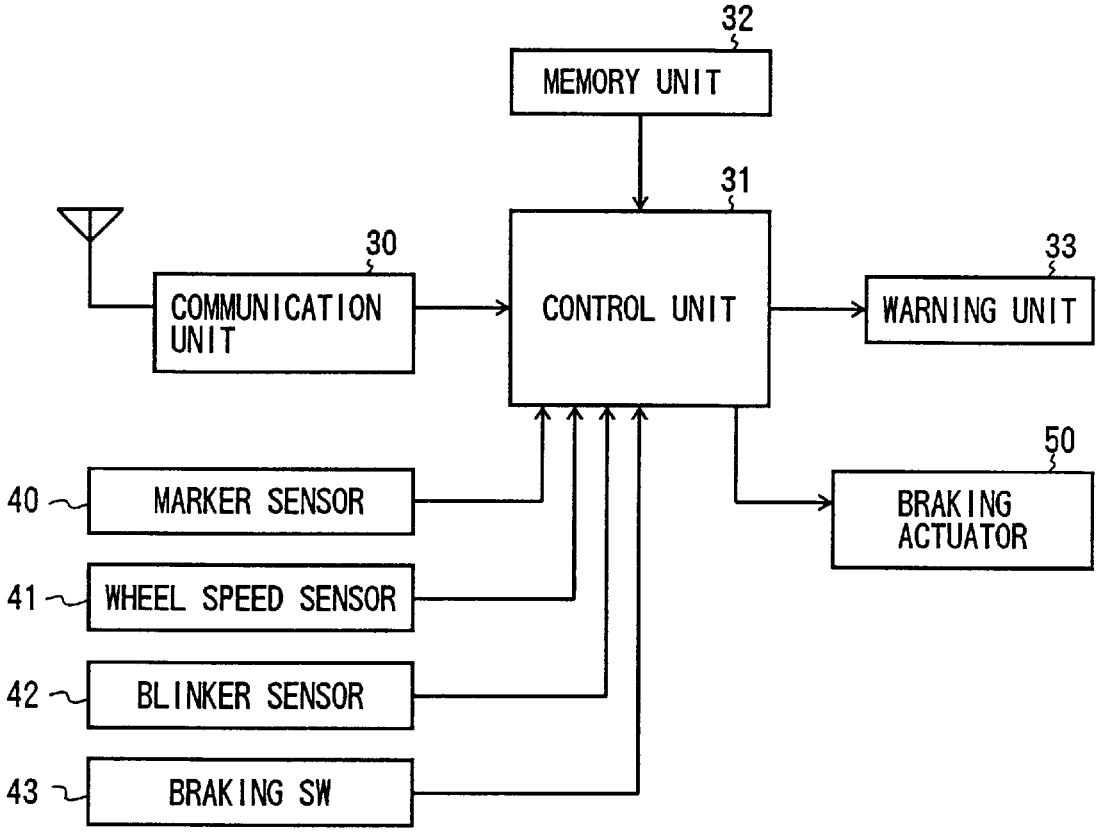
FIG. 3 is a block diagram illustrating an intersection warning system according to an embodiment of the present invention.

The intersection warning system has, as shown in FIG. 3, a communication unit 30, a control unit 31, a memory unit 32 and a warning unit 33. The communication unit 30 carries out data communication (the roadside-vehicle communication) with the roadside communication unit 100 and receives the information about running states of bodies in the watched area. The control unit 31 inputs the watching information received by the communication unit 30 and a detecting signal from a marker sensor 40, wheel speed pulses from a wheel speed sensor 41, a detecting signal from a direction indicating sensor 42 (a turn signal sensor) and an operation signal from a braking switch 43. The marker sensor 40 detects the information emitted by the lane marker 101 and outputs the detecting signal. The rate of the wheel speed pulses output from the wheel speed sensor 41 corresponds to a running speed of the intelligent vehicle. The direction indicating sensor 42 detects an operation of a direction indicator (a turn signal) and outputs the detecting signal indicating a direction in which the intelligent vehicle is going to turn. The braking switch 43 is driven by an operation of a braking pedal and outputs the operation signal. The control unit 31 calculates the relationship between the running states of the intelligent vehicle and another vehicle in the left sideward or rearward area of the intelligent vehicle based on the input watching information, the signals from the various types of sensors 40, 41 and 42, the operation signal from the braking switch 43 and various constants stored in the memory unit 32. The control unit 31 further generates a warning signal and brake control signal based on the calculated relationship.

The warning signal generated by the control unit 31 is supplied to the warning unit 33. The warning unit 33 thus outputs warning information, such as a warning message. The brake control signal generated by the control unit 31 is supplied to a brake actuator 50, so that the brake actuator 50 is driven by the brake control signal.

Figure 4:
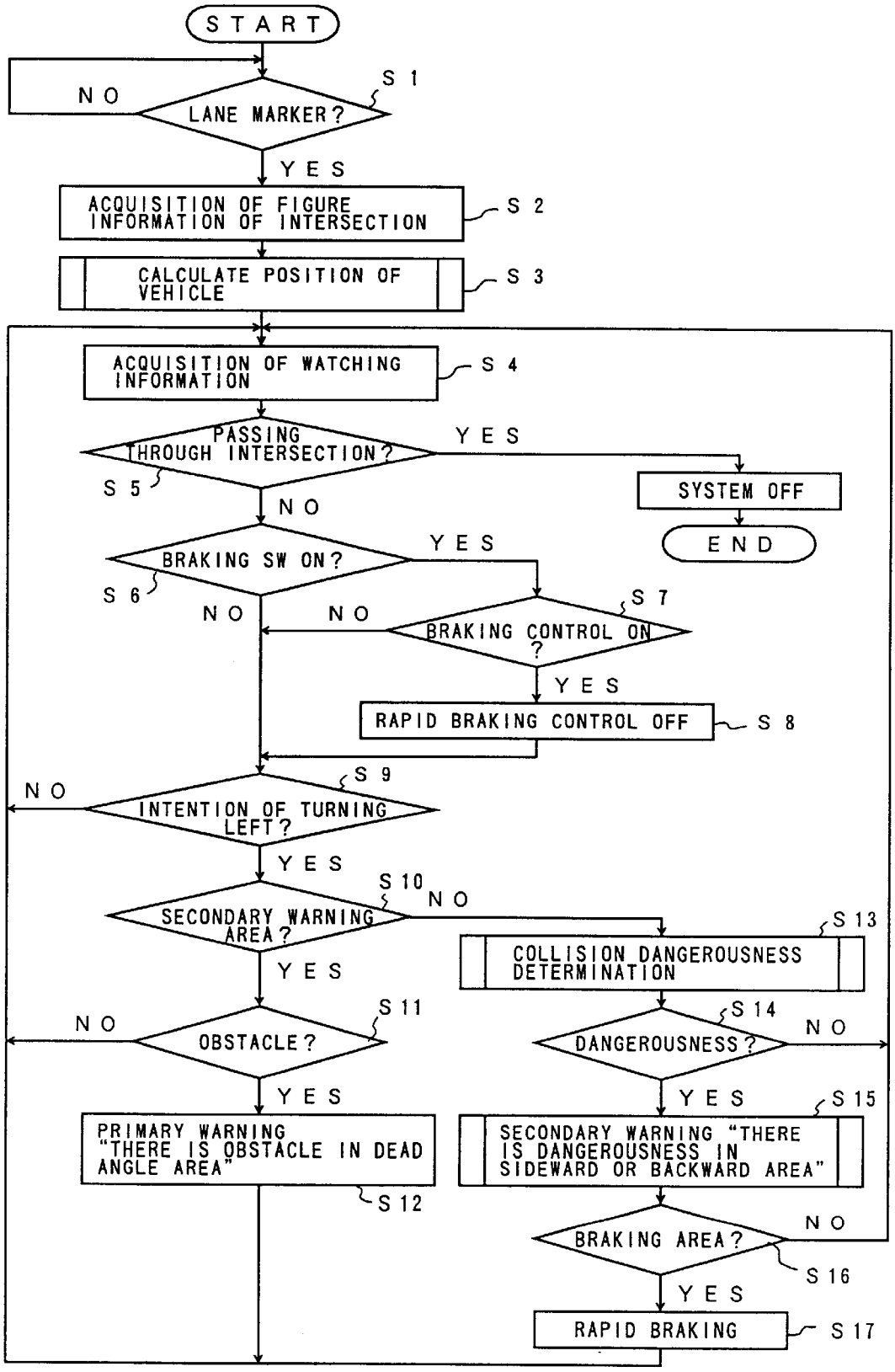
FIG. 4 is a flowchart illustrating a procedure of a process executed by a control unit of the intersection warning system shown in FIG. 3.

The control unit 31 generates the warning information and the brake control signal in accordance with a procedure as shown in FIG. 4.

Referring to FIG. 4, the control unit 31 is watching whether the detecting signal is supplied from the marker sensor 40 while the intelligent vehicle is running in the left-turn/straight pass lane (see FIG. 1) of the main road Rm (S1). The intelligent vehicle approaches the intersection and passes the lane marker 101 at the entrance of the primary warning area Em1. At this time, the control unit 31 recognizes, based on the detected signal from the marker sensor 40, a direction in which the intelligent vehicle approaches the intersection and an absolute position of the lane marker 101. When the control unit 31 obtains the figure information of the intersection included in the watching information, from the roadside communication unit 100, received by the communication unit 30 (S2), the control unit 31 calculates (identifies) a present position of the intelligent vehicle based on the received figure information of the intersection and the absolute position of the lane marker 101 (S3).

Further, after obtaining the watching information (S4), the control unit 31 calculates a running distance of the intelligent vehicle based on the wheel speed pulses from the wheel speed sensor 41 and determines, based on the distance from the lane marker 101, whether the intelligent vehicle has passed though the intersection (S5). While the intelligent vehicle is running in the primary warning area Em1 (has not yet passed through the intersection), the control unit 31 determines whether an ON-operation of the braking switch 43 is carried out (S6) and whether a driver is going to cause the intelligent vehicle to turn left (S9).

For example, when the driver carries out a braking operation to decrease the speed of the intelligent vehicle, the braking switch 43 is turned on. In this case, it is further determined whether a rapid braking operation, as will be described below, is carried out (S7). In a normal state (the rapid braking operation is not carried out), it is then determined whether the driver is going to cause the intelligent vehicle to turn left (S9).

A process (S9) for determining whether the driver is going to cause the intelligent vehicle to turn left is carried out as follows.

The control unit 31 is watching the detecting signal from the direction indicating sensor 42. When the direction indicator (the turn signal) is operated to turn left (the left turn operation), it is determined, based on the detecting signal from the direction indicating sensor 42, that the driver is going to cause the intelligent vehicle to turn left. There may be a case where although the driver is going to cause the intelligent vehicle to turn left, the direction indicator is not operated to turn left in error. In such a case, when the intelligent vehicle satisfies a predetermined deceleration condition, it is determined that the driver is going to cause the intelligent vehicle to turn left. In the predetermined deceleration condition, for example, the acceleration opening is maintained at "0" for a time period equal to or greater than 1.5 seconds and a deceleration calculated using the wheel speed data is greater than 0.15 G. When a steering angle of a steering wheel varies left by a value equal to or greater than 5 degrees per second, it may be determined that the driver is going to cause the intelligent vehicle to turn left.

Until it is determined, in the above manner, that the driver is going to cause the intelligent vehicle to turn left, the determination of whether the intelligent vehicle has passed through the intersection (S5) and the determination of whether the braking switch 43 is turned on are repeatedly carried out (S6).

When it is determined that the driver is going to cause the intelligent vehicle to turn left (YES in S9), the control unit 31 further determines, based on the calculated running distance, whether the intelligent vehicle is in the secondary warning area Em2 (S10). If the intelligent vehicle is still in the primary warning area Em1 (NO in S10), the control unit 31 determines, based on the acquired watching information (see S4), whether there is another vehicle (an obstacle) approaching the intersection from the left sideward or rearward area of the intelligent vehicle (S11). If there is such a vehicle, the control unit 31 supplies a primary warning information, such as a message "THERE IS AN OBSTACLE IN THE DEAD ANGLE AREA", to the warning unit 33. As a result, the warning unit 33 outputs a sound or an image of the primary warning (S12). After this, the processes as described above are repeated.

When the primary warning information, such as a message "THERE IS AN OBSTACLE IN THE DEAD ANGLE AREA", is output by the warning unit 33, the driver can drive the intelligent vehicle, while recognizing an obstacle (another vehicle in the left sideward or rearward area), to approach the intersection at which the intelligent vehicle should turn left.

On the other hand, if there is no vehicle in the left sideward or rearward area of the intelligent vehicle (No in S11), the processes as described above are repeated without outputting the warning information.

When the intelligent vehicle which is decelerating with the left direction indicated (a left turn signal) proceeds from the primary warning area Em1 to the secondary warning area Em2 (YES in S10), the control unit 31 carries out a collision danger determination process (S13). The collision danger determination process is carried out as follows.

The control unit 31 receives the watching information, including the figure information of the intersection and a position and a moving vector (which is a general idea including a speed) of another vehicle, from the road watching apparatus via the communication unit 30. Based on the figure information of the intersection and the position and moving vector of the other vehicle, the control unit 31 calculates a time period required for the other vehicle running from the present position to reach a left-turn position in the intersection. The left-turn position is a position at which a vehicle generally turns left in the intersection. In addition, a position, a speed and a deceleration of the intelligent vehicle are calculated based on the wheel speed pulses from the wheel speed sensor 41. Further, based on the calculated position, speed and deceleration of the intelligent vehicle, a time period required for the intelligent vehicle running from the present position to reach the left-turn position in the intersection is calculated. An estimating calculation for estimating whether the intelligent vehicle and the other vehicle in the left sideward or rearward area of the intelligent vehicle are going to come into contact with each other at the left-turn position in the intersection is carried out based on the relationship between both the calculated time periods. That is, the smaller the difference between both the calculated time periods, the larger a possibility of contact of the intelligent vehicle with the other vehicle.

Figure 5:
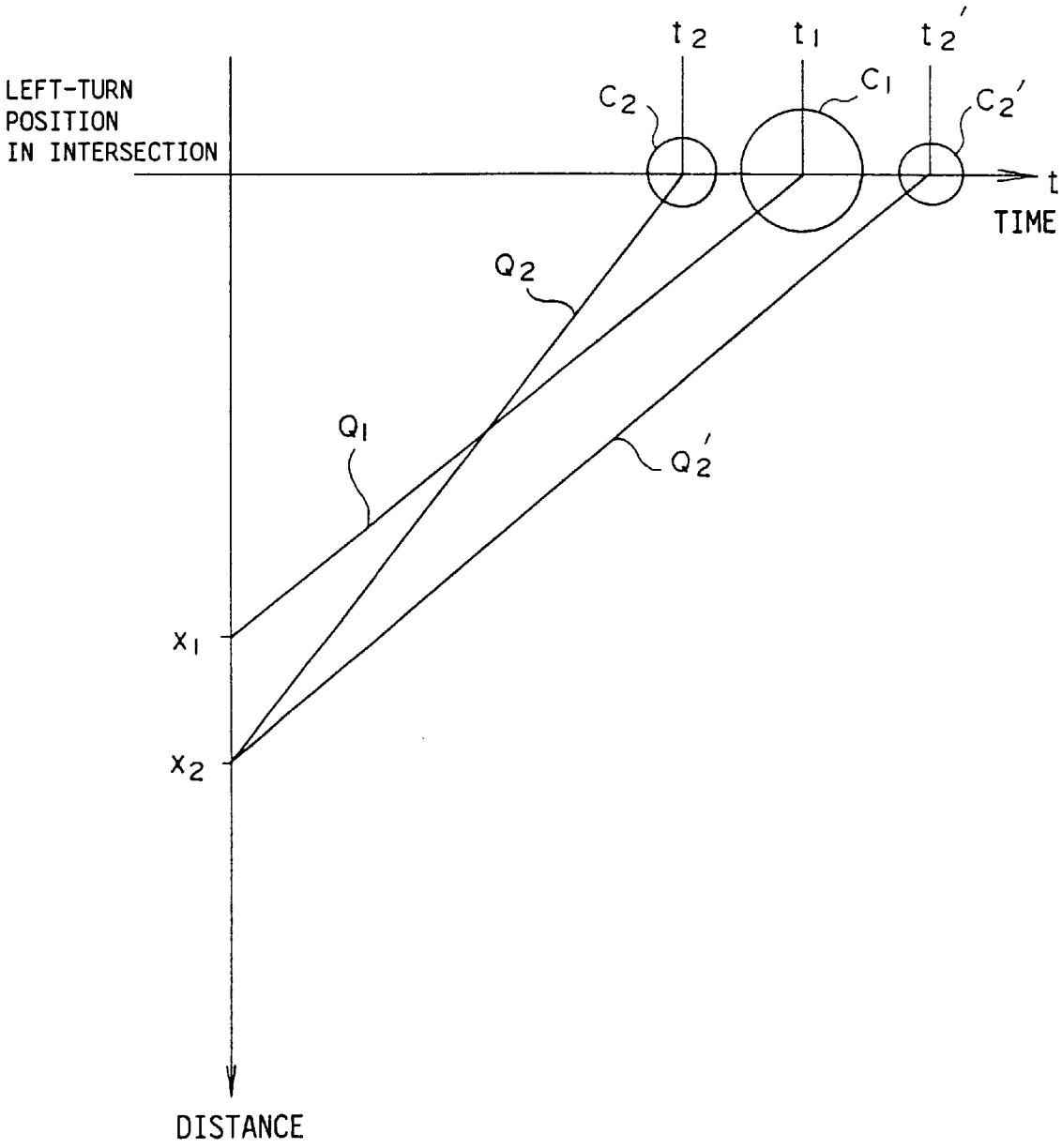
FIG. 5 is a diagram illustrating a possibility of contact between vehicles at a left-turn position in an intersection (the first)

For example, as shown in FIG. 5, in a case where the intelligent vehicle is at a position x1, a time period t1 required for the intelligent vehicle to reach the left-turn position in the intersection is calculated from a speed characteristic Q1 obtained based on the speed and the deceleration at the position x1. An encounter circle C1 is defined at a time t1. The encounter circle C1 depends on the size and speed of the intelligent vehicle at the left-turn position. An area in the encounter circle C1 means that a probability of contact (a factor of encounter) with the intelligent vehicle is equal to or greater than a predetermined value.

In addition, in a case where the other vehicle in the left sideward or rearward area of the intelligent vehicle is at a position x2, a time period t2 required for the other vehicle to reach the left-turn position in the intersection is calculated from a speed characteristic Q2 obtained based on the speed and the deceleration at the position x2. In a case where the other vehicle has a speed characteristic Q2', a time period t2' required for the other vehicle to reach the left-turn position in the intersection is calculated. Encounter circles C2 and C2' are respectively defined at the times t2 and t2'. The encounter circles C2 and C2' depend on the size of the other vehicle and the speed of the other vehicle at the left-turn position. An area in each of the encounter circles C2 and C2' means that a probability of contact with the other vehicle is equal to or greater than a predetermined value.

Figure 6:
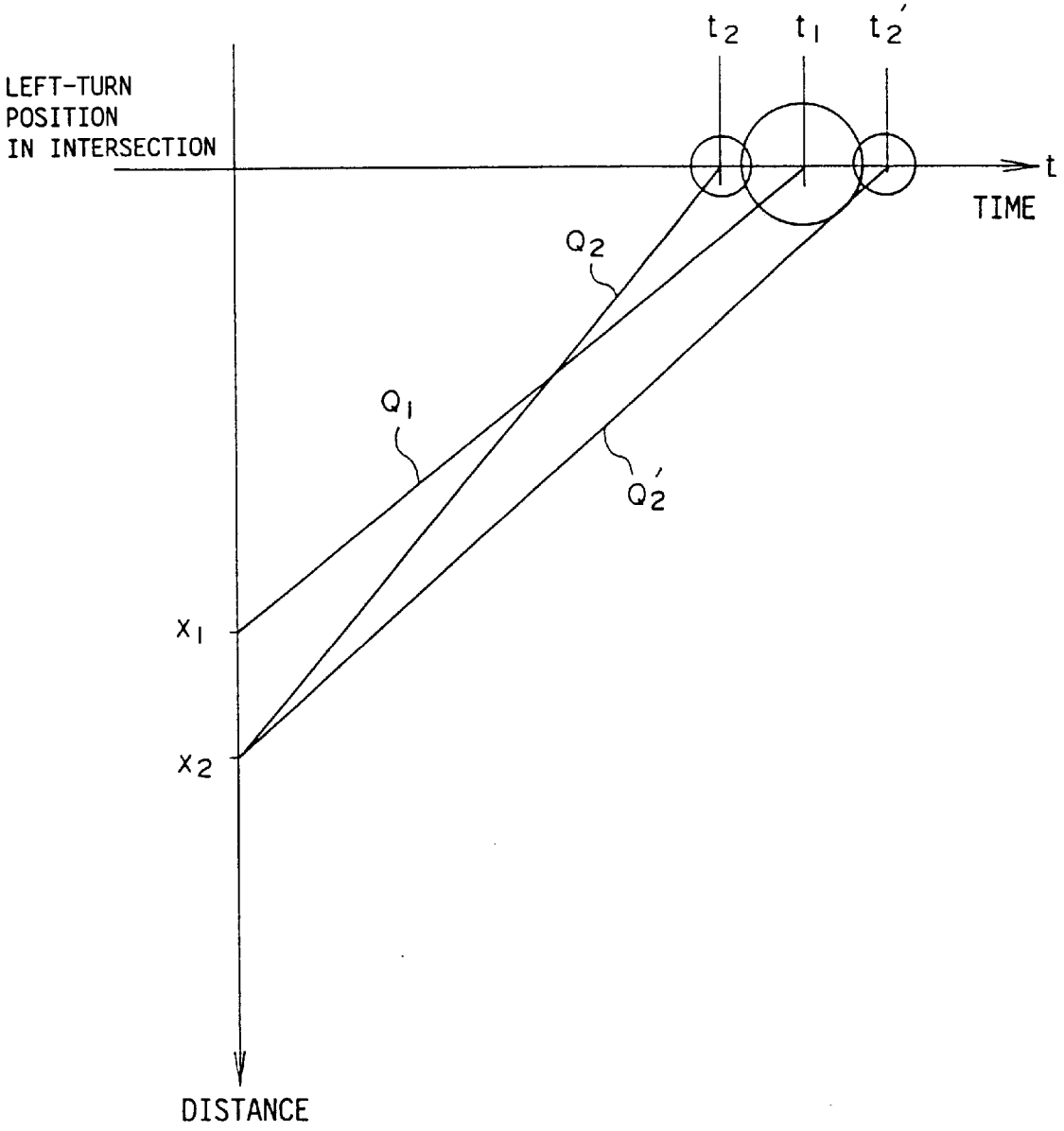
FIG. 6 is a diagram illustrating a possibility of contact between vehicles at a left-turn position in an intersection (the second).

Thus, in a case where the encounter circle C1 of the intelligent vehicle at the time t1 and each of the encounter circles C2 and C2' of the other vehicle at the times t2 and t2' do not overlap each other as shown in FIG. 5, it is determined that there is no danger of contact between the intelligent vehicle and the other vehicle. On the other hand, in a case where the encounter circle C1 of the intelligent vehicle and each of the encounter circles C2 and C2' of the other vehicle in the left sideward and rearward area of the intelligent vehicle overlap each other as shown in FIG. 6, it is determined that there is a danger of contact between the intelligent vehicle and the other vehicle.

When it is determined, based on the result obtained in the collision danger determination process (S13) as described above, that there is a danger of contact between the intelligent vehicle and the other vehicle in the left sideward and rearward area of the intelligent vehicle at the left-turn position in the intersection (YES in S14), the control unit 31 supplies secondary warning information to the warning unit 33 (S15). As a result, the warning unit 33 outputs a warning message, such as "THERE IS A DANGER IN THE SIDEWARD OR REARWARD AREA" and a warning sound. After this, the control unit 31 determines whether the intelligent vehicle has entered a braking area (S16). A predetermined area located near the intersection in the secondary warning area Em2 is defined as the braking area. If the intelligent vehicle is not in the braking area (has not yet entered the braking area), the acquisition of the watching information (S4), the respective determination steps (S5, S6 (S7), S9 and S10), the collision danger process (S13) and the output process of the secondary warning information (S14 and S15) are repeatedly carried out.

For example, an area 3.5 meters before the intersection in the secondary warning area Em2 is defined. The length of 3.5 meters is a length required for a vehicle running at 30 Km/h to stop with a deceleration of 1 G. When the driver does not correct the driving operation although the secondary warning information is output so that the vehicle enters the braking area (YES in S16), the control unit 31 outputs a braking control signal to the braking actuator 50 to compulsorily brake the intelligent vehicle (S17). The braking actuator 50 is driven based on the braking control signal so that the intelligent vehicle is rapidly braked.

After this, the processes as described above are carried out while the intelligent vehicle is being braked. In this state, when the driver steps on the braking pedal so as to carry out the braking operation, the control unit 31 recognizes that the braking switch 43 is turned on (YES in S6). As a result, the braking control is released (off) (S7 and S8). Thus, due to the driving operation (the braking operation and the steering operation), the contact between the intelligent vehicle and the other vehicle in the sideward area of the intelligent vehicle is avoided.

In the above processes, when it is determined, based on the running distance calculated using the wheel speed pulses from the wheel speed sensor 41, that the intelligent vehicle has passed through the intersection, the control unit 31 turns off the system and terminates the process.

According to the intersection warning system as described above, while the intelligent vehicle is running in the primary warning area Em1, a warning indicating that there is another vehicle in the left sideward and rearward area of the intelligent vehicle is supplied to the driver to pay attention to the other vehicle. In addition, while the intelligent vehicle is running in the secondary warning area Em2, the warning information is supplied to the driver in a state where there is a danger of contact between the intelligent vehicle and the other vehicle in the left sideward and rearward area of the intelligent vehicle. Thus, the driver can accurately correct the driving operation of turning left, under consideration of the other vehicle in the left sideward and rearward area of the intelligent vehicle, based on the warning varied in accordance with approaching the intersection. Further, even if the driving operation is not appropriately corrected, the intelligent vehicle is compulsorily braked before turning left. Thus, the contact between the intelligent vehicle and another vehicle in the sideward area of the intelligent vehicle can be avoided. As a result, the intelligent vehicle can turn left at the intersection in a safer state.

In the above embodiment, the intersection warning system is applied to a case where every vehicle ought to run on the left side of a road. In a case where every vehicle ought to run on the right side of a road, the intersection warning system can have the same structure as in the above embodiment to supply a warning to the driver when the intelligent vehicle is going to turn right at an intersection.

In a case where every vehicle ought to run on a right side of a road (e.g., in US), the intersection warning system according to the present invention is useful for a vehicle which is going to turn right at an intersection.

The present invention is not limited to the aforementioned embodiments, and other variations and modifications may be made without departing from the scope of the claimed invention.

The present application is based on Japanese priority application No.9-206970 filed on Jul. 31, 1997, the entire contents of which are hereby incorporated by reference.

What is claimed is:

1. An intersection warning system provided in a first vehicle, comprising:

a receiving unit receiving information about a running state of a second vehicle near a roadside edge in a sideward or rearward area of said first vehicle, the information being transmitted from a roadside system watching a predetermined watched area through which vehicles approaching an intersection pass;

a running state detecting unit detecting a running state of said first vehicle;

an estimation unit estimating a relative positional relationship between said first and second vehicles in the intersection based on the running state of said first vehicle detected by said running state detecting unit and the information about the running state of said second vehicle received by said receiving unit; and a warning unit issuing a warning to a driver of said first vehicle based on an estimation result obtained by said estimation unit.

2. An intersection warning system provided in a first vehicle, comprising:

a receiving unit receiving information about a running state of a second vehicle near a roadside edge in a sideward or rearward area of said first vehicle, the information being transmitted from a roadside system watching a predetermined watched area through which vehicles approaching an intersection pass;

a running state detecting unit detecting a running state of said first vehicle;

an estimation unit estimating a relative positional relationship between said first and second vehicles in the intersection based on the running state of said first vehicle detected by said running state detecting unit and the information about the running state of said second vehicle received by said receiving unit;

a warning unit issuing a warning to a driver of said first vehicle based on an estimation result obtained by said estimation unit;

a determination unit determining whether the driver of said first vehicle is going to cause said first vehicle to turn at the intersection along a roadside edge without crossing the road; and a first control unit allowing said warning unit to issue the warning to the driver when said determination unit determines that the driver of said first vehicle is going to cause said first vehicle to turn at the intersection along the roadside edge.

3. An intersection warning system provided in a first vehicle, comprising:

a receiving unit receiving information about a running state of a second vehicle near a roadside edge in a sideward or rearward area of said first vehicle, the information being transmitted from a roadside system watching a predetermined watched area through which vehicles approaching an intersection pass, wherein said watched area is segmented into a first area and a second area which is nearer the intersection than the first areas a running state detecting unit detecting a running state of said first vehicle;

an information supply unit supplying information indicating that there is another vehicle near the roadside edge in the sideward or rearward area of said first vehicle, based on the information about the running state of said second vehicle received by said receiving unit, to the driver when said first vehicle is running in the first area;

an estimation unit estimating a relative positional relationship between said first and second vehicles in the intersection based on the running state of said first vehicle detected by said running state detecting unit and the information about the running state of said second vehicle received by said receiving unit;

a warning unit issuing a warning to a driver of said first vehicle based on an estimation result obtained by said estimation unit; and a control unit allowing said warning unit to issue the warning to the driver when said first vehicle is running in the second area.

4. An intersection warning system provided in a first vehicle, comprising:

a receiving unit receiving information about a running state of a second vehicle near a roadside edge in a sideward or rearward area of said first vehicle, the information being transmitted from a roadside system watching a predetermined watched area through which vehicles approaching an intersection pass;

a running state detecting unit detecting a running state of said first vehicle;

an estimation unit estimating a relative positional relationship between said first and second vehicles in the intersection based on the running state of said first vehicle detected by said running state detecting unit and the information about the running state of said second vehicle received by said receiving unit;

a warning unit issuing a warning to a driver of said first vehicle based on an estimation result obtained by said estimation unit; and a braking control unit carrying out a braking control of said first vehicle based on the estimation result obtained by said estimation unit.

5. The intersection warning system as claimed in claim 2, wherein said determination unit comprises a detecting unit detecting a direction indicated by a direction indicator of an intended turn at the intersection along the roadside edge without crossing the road, and wherein when said detecting unit detects the direction, it is determined that the driver is going to cause said first vehicle to turn at the intersection along the roadside edge without crossing the road.

6. The intersection warning system as claimed in claim 2, wherein said determination unit comprises a unit determining, based on the running state of said first vehicle detected by said running state detecting unit, whether the first vehicle approaching the intersection satisfies a predetermined deceleration condition, and wherein when said unit determines that the first vehicle approaching the intersection satisfies the predetermined condition, it is determined that the driver is going to cause the first vehicle to turn at the intersection along the roadside edge without crossing the road.

7. The intersection warning system as claimed in claim 2, wherein said determination unit comprises a unit determining whether a steering wheel of said first vehicle approaching the intersection is operated at a rate equal to or greater than a predetermined rate, and wherein when said unit determines that the steering wheel is operated at a rate equal to or greater than the predetermined rate, it is determined that the driver is going to cause said first vehicle to turn at the intersection along the roadside edge without crossing the road.

8. An intersection warning system provided in a first vehicle, comprising:

receiving means for receiving information about a running state of a second vehicle near a roadside edge in a sideward or rearward area of said first vehicle, the information being transmitted from a roadside system watching a predetermined watched area through which vehicles approaching an intersection pass;

running state detecting means for detecting a running state of said first vehicle;

estimation means for estimating a relative positional relationship between said first and second vehicles in the intersection based on the running state of said first vehicle detected by said running state detecting unit and the information about the running state of said second vehicle received by said receiving unit; and warning means for issuing a warning to a driver of said first vehicle based on an estimation result obtained by said estimation unit.

9. An intersection warning system provided in a first vehicle, comprising:

receiving means for receiving information about a running state of a second vehicle near a roadside edge in a sideward or rearward area with respect to the first vehicle, the information being transmitted to a roadside system watching a predetermined watch area through which vehicles approaching an intersection pass;

running state detection means for detecting a running state of the first vehicle;

estimation means for estimating a relative positional relationship between the first and second vehicles in the intersection based on the running state of the first vehicle detected by the running state detection means and a running state of the second vehicle received by said receiving means;

warning means for issuing a warning to a driver of the first vehicle based on the relative positional relationship in the intersection estimated by said estimation means;

determination means for determining whether a driver of the first vehicle is going to cause the first vehicle to turn at the intersection along a roadside edge when crossing a road; and first control means for allowing said warning means to issue the warning to the driver of the first vehicle when said determination means determines that the driver of the first vehicle is going to cause the first vehicle to turn at the intersection along the roadside edge.

10. The intersection warning system as claimed in claim 9, wherein said watched area is segmented into a first area and a second area which is nearer the intersection than the first area, and wherein said system further comprises:

information supply means for supplying information indicating that there is another vehicle near the roadside edge in the sideward or rearward area of said first vehicle, based on the information about the running state of said second vehicle received by said receiving means, to the driver while said first vehicle is running in the first area; and second control means for allowing said warning unit to issue the warning to the driver when said first vehicle is running in the second area.

11. The intersection warning system as claimed in claim 9 further comprising:

braking control means for carrying out a braking control of said first vehicle based on the result obtained by said estimation unit.

* * * * *

UNITED STATES PATENT AND TRADEMARK OFFICE

CERTIFICATE OF CORRECTION

PATENT NO. : 6,307,484 B1
DATED : October 23, 2001
INVENTOR(S) : Kenji Sasaki et al.

It is certified that error appears in the above-identified patent and that said Letters Patent is hereby corrected as shown below:

Column 9, claim 3,
Line 55, "areas" should read -- area --.

Signed and Sealed this

Fifth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,307,484 B1
DATED : October 23, 2001
INVENTOR(S) : Kenji Sasaki et al.

It is certified that error appears in the above-identified patent and that said Letters Patent is hereby corrected as shown below:

Title page,
Item [73], Assignee, after "Toyota Jidosha Kabushiki Kaisha, Aichi-ken (JP)", insert -- Hino Jidosha Kogyo Kabushiki Kaisha, Tokyo (JP); Aisin Seiki Kabushiki Kaisha, Aichi-ken (JP); and Denso Corporation, Kariya City, Aichi-Pref. (JP) --.

Signed and Sealed this

Twelfth Day of November, 2002

*Attest:*

*Attesting Officer*

JAMES E. ROGAN
*Director of the United States Patent and Trademark Office*